United States Patent [19]

Takahata

[11] Patent Number: 4,731,806

[45] Date of Patent: Mar. 15, 1988

[54] GRID MOVING APPARATUS FOR RADIOGRAPHY

[75] Inventor: Hideo Takahata, Kawachi, Japan

[73] Assignee: Kabushiki Kaisha Toshiba, Kawasaki, Japan

[21] Appl. No.: 842,555

[22] Filed: Mar. 21, 1986

[30] Foreign Application Priority Data

Mar. 26, 1985 [JP] Japan ..... 60-63106

[51] Int. Cl.[4] ..... G21K 1/02; G21K 1/00

[52] U.S. Cl. ..... 378/155; 378/154

[58] Field of Search ..... 378/155, 154

[56] References Cited

U.S. PATENT DOCUMENTS

| | | | |
|---|---|---|---|
| 2,733,352 | 1/1956 | Billin | 378/155 |
| 2,938,120 | 5/1960 | Forsyth | 378/155 |
| 3,936,639 | 2/1976 | Barrett | 250/369 |
| 4,105,920 | 8/1978 | Pury et al. | 378/155 |

FOREIGN PATENT DOCUMENTS

| | | |
|---|---|---|
| 2519317 | 11/1975 | Fed. Rep. of Germany . |
| 44-11466 | 5/1969 | Japan . |

*Primary Examiner*—Carolyn E. Fields
*Assistant Examiner*—Joseph A. Hynds
*Attorney, Agent, or Firm*—Finnegan, Henderson, Farabow, Garrett & Dunner

[57] ABSTRACT

A grid moving apparatus for X-ray radiographing comprises a grid for eliminating a scattered X-ray beam, said grid having X-ray transmitting regions and X-ray non-transmitting regions alternately arranged, swinging mechanism for swinging said grid at a radiographing position, and escape mechanism for removing said grid from the radiographing position to a non-radiographing position. The apparatus further comprises engaging mechanism for detachably engaging said swinging mechanism and said grid, in which said grid and said swinging mechanism are engaged with each other to swing the grid, and said grid is disengaged from said swinging mechanism to be removed.

10 Claims, 4 Drawing Figures

GRID MOVING APPARATUS FOR RADIOGRAPHY

BACKGROUND OF THE INVENTION

The present invention relates to a grid moving apparatus arranged in a radiographing apparatus for irradiating an object with X-rays.

For example, in an x-ray diagnostic apparatus for diagnosing a patient upon irradiation of X-rays, a grid is arranged in front of a film for recording an X-ray image to control the incident X-ray on the film. In the X-ray radiographing mode, scattering X-ray beams are generated from the object when X-rays have passed through the object (patient). If the scattered X-ray beams are incident on the film, the contrast and quality of a resultant radiograph are degraded. Therefore, the scattered beams are eliminated by the grid in the X-ray radiographing mode.

Such a grid is formed by alternately arranging segments (e.g., lead) which do not pass X-rays and other segments (e.g., hole, wood, paper, aluminum and the like) which pass X-rays. With this structure, the grid permits transmission of a direct X-ray beam passed through the object, and inhibits transmission of scattered beams from the object.

However, since the segments form a grid pattern, if the grid is fixed in position, a grid pattern image may be formed on the film. For this reason, a swing mechanism is coupled to the conventional apparatus swinging the grid, thereby forming no grid pattern image on the film.

X-rays passed through the object are partially eliminated by the grid. Therefore, X-rays of a relatively high does are to be irradiated from an X-ray tube. However, when joints are to be imaged or when the patient is a child, X-rays of a low dose are projected in order to prevent adverse influence of the X-rays on the body. In this case, the grid must be removed from an X-ray imaging position.

Therefore, both mechanisms for swinging the grid and for selectively removing it from the imaging position are required.

Although they can be simply combined, this results in a complicated, bulky grid moving apparatus.

SUMMARY OF THE INVENTION

It is an object of the present invention to provide a simple, compact grid moving apparatus which can selectively swing and remove a grid from an imaging position.

According to an aspect of the present invention, there is provided a grid moving apparatus for an X-ray radiographing apparatus: having a grid, for eliminating a scattered X-ray beam with X-ray transmitting regions and X-ray non-transmitting regions alternatively arranged; swinging means for swinging said grid at a radiographing position; and escape or removing means for removing said grid from the radiographing position to a non-radiographing position, characterized by further comprising engaging means for detachably engaging said swinging means and said grid, in which said grid and said swinging means are engaged with each other to swing the grid, and said grid is disengaged from said swinging means to be removed.

DETAILED DESCRIPTION OF THE PREFERRED EMBODIMENTS

Embodiments of the present invention will be described in detail with reference to FIGS. 1 to 4.

Figure 1:
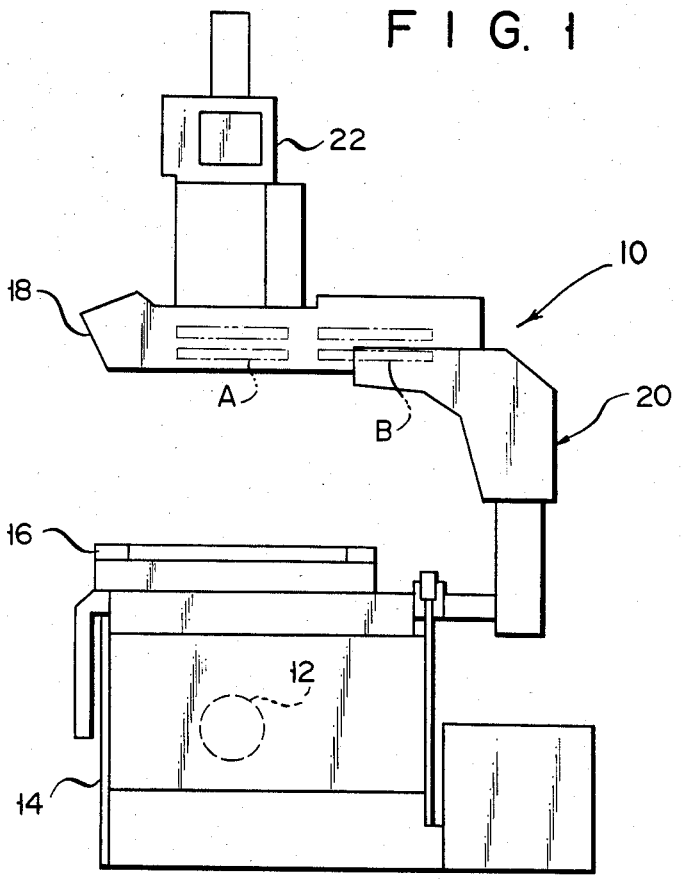
FIG. 1 is a schematic front view showing an X-ray diagnostic apparatus used in an embodiment of the present invention.

As shown in FIG. 1, in X-ray diagnostic apparatus 10, X-ray tube 12 for irradiating X-rays is arranged on a table 14. Top plate 16 on which a patient lies is placed on table 14. Spot-shot imaging unit 18 for recording an X-ray image of the patient on film is arranged above top plate 16. Unit 18 is supported by supporting unit 20 to table 14. X-ray TV camera 22 is arranged on unit 18, and is connected to a TV monitor (not shown).

Figure 2:
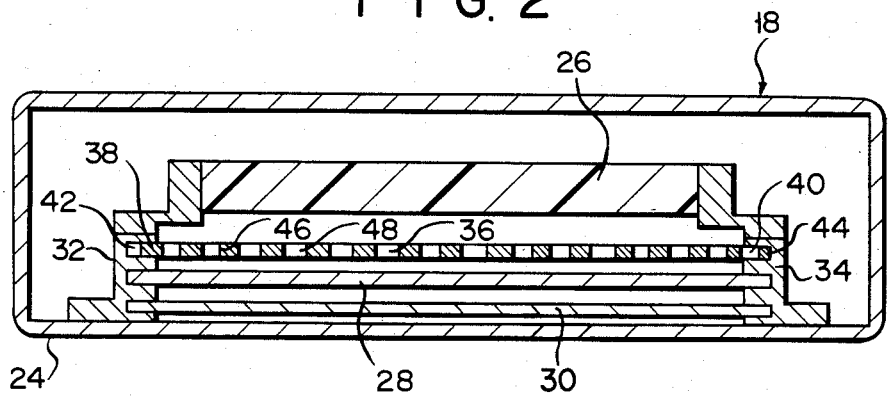
FIG. 2 is a schematic sectional view of a spot-shot imaging unit of the apparatus shown in FIG. 1.

As shown in FIG. 2, in unit 18, film 26 and two dividing masks 28 and 30 are supported in housing 24 by supporting members 32 and 34, and arranged parallel to each other. Supporting members 32 and 34 are slidably engaged with pairs of opposing edge portions of masks 28 and 30, respectively. X-rays irradiated onto film 26 are controlled by sliding masks 28 and 30. Therefore, an X-ray image is formed on a ½ or ¼ divided film.

Grid 36 for controlling X-rays projected onto film 26 is arranged between film 26 and masks 28 and 30, substantially parallel to masks 28 and 30. A pair of opposing side portions 38 and 40 of grid 36 are slidably engaged with grooves 42 and 44 cut in members 32 and 34.

In grid 36, lead segments 46 which do not pass X-rays and segments 48 (e.g., hole, wood, paper, or aluminum) which pass X-rays are arranged alternately, providing a grid density of 34 elements/cm and a thickness of 2 to 3 mm. With this structure, grid 36 transmits direct beams passed through an object but does not transmit scattered beams therefrom.

Moving mechanism 50 for moving grid 36 will now be described with reference to FIG. 3. Moving mechanism 50 comprises grid escape mechanism 52 for moving grid 36 from imaging position A (FIG. 1) to non-imaging position B (FIG. 1) as needed, and swing mechanism 54 for swingably reciprocating grid 36 in an imaging mode.

Grid escape mechanism 52 has first motor 56, the shaft of which is connected to driving pulley 58 by clutch 57. Driven pulley 60 is arranged remote from pulley 58 in a sliding direction (arrow S) of grid 36. Wire 62 is looped between pulleys 58 and 60, and one end portion of wire 62 is engaged with hole 67 formed, in front edge portion 64 of grid 36 in the sliding direction thereof, at one side portion 38 of grid 36. The other end portion of wire 62 is engaged with rear edge portion 70 of grid 36 through coil spring 68. The coil spring 68 absorbs the shocks generated when grid 36 is moved and stopped. With this structure of mechanism 52, grid 36 can be moved by motor 56 between imaging position A and non-imaging position B.

Figure 3:
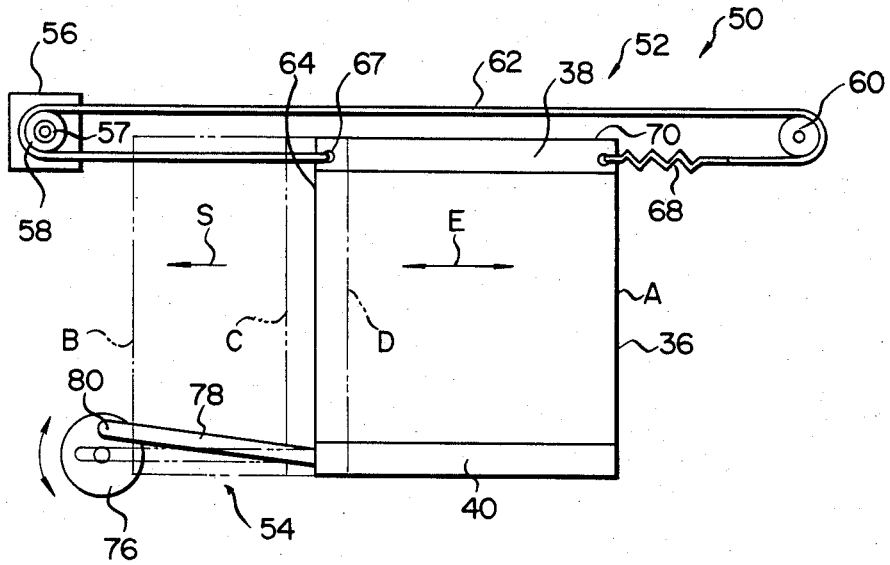
FIG. 3 is a schematic plan view of a grid moving apparatus.
Figure 4:
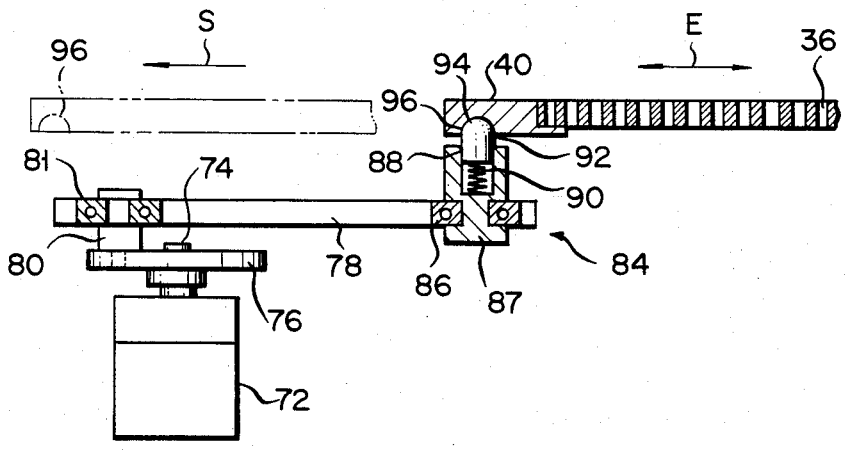
FIG. 4 is a partially cut away, sectional view showing an engaging mechanism of the apparatus shown in FIG. 3.

Swing mechanism 54, as shown in FIGS. 3 and 4, has second motor 72, shaft 74 fixed to disk plate 76. Pin 80 projects from disk plate 76 and is not coaxial therewith. One end portion of crank shaft 78 is axially supported to a distal end portion of pin 80 by bearing 81, to be pivotal thereabout.

The other end portion of crank shaft 78 is engaged through engaging mechanism 84 with front edge portion 64 of grid 36 at the other side portion 40 thereof.

As seen in FIG. 4, boss 87 is axially supported by the other end portion of crank shaft 78 through bearing 86. Recess 88 is cut in an upper end portion of boss 87. Coil spring 90 and engaging member 92, which is arranged on spring 90 and is biased upward thereby, are arranged in recess 88. An upper half of member 92 extends from boss 87, urged by spring 90. Upper end portion 94 of member 92 has a semi-spherical shape. Semi-spherical hole 96 is formed in a lower surface of other side portion 40 of grid 36 to receive upper end portion 94 of member 92.

The operation of the grid moving mechanism of this embodiment will now be described.

To swing grid 36 in the direction of arrow E, motor 72 is driven to rotate disk plate 76 through shaft 74. Boss 87 axially supported by the other end portion of crank shaft 78 linearly reciprocates upon rotation of plate 76. Therefore, grid 36 can be swung upon rotation of motor 72.

If grid 36 is to be swung only by vibration of a coil spring, the frequency of vibration may be gradually attenuated. In this embodiment, however, since grid 36 is swung by motor 72, it can be swung at a constant frequency. In this case, grid 36 is reciprocated between positions C and D, as indicated by alternate long and two short dashed lines in FIG. 3. Note that when grid 36 is to be swung, clutch 57 is released.

An X-ray radiographing mode is executed such that dividing masks 28 and 30 are moved while swinging grid 36 to divide an imaging area of film. Grid 36 prevents the film from being irradiated with a scattered X-ray beam and swings to prevent a grid image from forming on the film.

When an X-ray radiograph of a child or joint is to be formed, an X-ray does to be radiated must be reduced and grid 36 must be removed. In this case, clutch 57 is engaged to drive first motor 56, thereby rotating first pulley 58 clockwise.

In this case, grid 36 moves in a direction indicated by arrow S in FIGS. 3 and 4. Although engaging hole 96 of grid 36 receives engaging member 92, a horizontal force (in a direction of arrow S) is applied to member 92. A force (in a direction perpendicular to arrow S) for moving member 92 downward is also applied to member 92, since upper end portion 94 of member 92 has a semi-spherical shape. When member 92 is moved downward against the force of spring 90, other side portion 40 of grid 36 is disengaged from engaging member 92. More specifically, given frictional force acts between member 92 and portion 40, and when horizontal force greater than frictional force is applied to portion 40 of grid 36, member 92 is slid along semispherical shape of portion 40 and is moved downward. Therefore, grid 36 is moved in the direction indicated by arrow S to the non-radiographing position indicated by arrow B in FIGS. 1 and 3, and first motor 56 is then stopped.

If grid 36 is set for the radiographing mode, motor 56 is rotated counterclockwise to return grid 36 to radiographing position A. Thus, upper end portion 94 of member 92 enters hole 96 and is engaged with side portion 40 of grid 36.

The present invention is not limited to the above embodiment, and various changes and modifications may be made within the spirit and scope of the invention.

For example, in the engaging mechanism, the upper end portion of the engaging member is formed into a semi-spherical shape and is engaged with the other side portion of the grid. However, the present invention is not limited to this. The upper end portion of the engaging member can be formed flat, and a frictional member (e.g., a rubber member) can be attached thereon. In this case, the other side portion of the grid to be engaged with the engaging member is formed also flat.

Furthermore, engagement of the engaging mechanism is not limited to frictional engagement. For example, the engaging mechanism can be achieved by a mechanism (e.g., an electromagnet) for disengaging the swing mechanism to be interlocked with energization of a motor (first motor) in the escape mechanism.

What is claimed is:

1. A grid moving apparatus for an x-ray radiographing apparatus, comprising:

a grid for eliminating a scattered X-ray beam, said grid having X-ray transmitting regions and x-ray non-transmitting regions alternately arranged;

reciprocating means for reciprocating said grid at a constant frequency between imaging positions, said reciprocating means having a motor and a crank shaft for converting rotation of said motor into a linear motion;

removing means for moving said grid between an imaging position and a non-imaging position; and engaging means for detachably engaging said reciprocating means and said grid, said engaging means having an engaging member provided at the distal end portion of said crank shaft and a spring means for pressing said engaging member to be frictionally engaged with said grid.

wherein said grid and said reciprocating means are engaged with each other to reciprocate the grid, and said reciprocating means and said grid are disengaged from each other to move said grid between said imaging position and said non-imaging position.

2. An apparatus according to claim 1, wherein said engaging means comprises a recess formed on a side of said grid, which is engaged with an upper end portion of said engaging member.

3. An apparatus according to claim 2, wherein the upper end portion of said engaging member is formed in a semispherical shape and said recess is also formed in a semi-spherical shape to receive said upper end portion.

4. An apparatus according to claim 3, wherein said engaging means includes a boss having a hole for slidably housing said engaging member and having a coil spring for biasing said engaging member upward disposed in said hole.

5. An apparatus according to claim 1, wherein said removing means includes a motor, a pulley rotated by said motor, and a wire looped around said pulley, and having two end portions coupled to said grid.

6. An apparatus according to claim 5, wherein said wire is coupled to said grid through a spring which absorbs shocks when said grid is moved between an imaging position and a non-imaging position and stopped.

7. An apparatus according to claim 5, wherein said pulley is provided with a clutch for engaging or disengaging a driving force of said motor.

8. An apparatus according to claim 1, wherein said grid has a density of approximately 34 elements/cm.

9. An apparatus according to claim 1, wherein said grid has a thickness of approximately 2 to 3 mm.

10. An apparatus according to claim 8, wherein said grid has a thickness of approximately 2 to 3 mm.

* * * * *